US008757843B1

(12) United States Patent
Lee

(10) Patent No.: US 8,757,843 B1
(45) Date of Patent: Jun. 24, 2014

(54) HEAT COOLING APPARATUS ASSEMBLY OF LED ILLUMINATING DEVICE HAVING HEAT PIPE AND HEAT SINK

(71) Applicant: Il Sung Co., Ltd., Gyeonggi-do (KR)

(72) Inventor: Won Bom Lee, Gyeonggi-do (KR)

(73) Assignee: Il Sung Co., Ltd., Gyeonggi-Do (KR)

( * ) Notice: Subject to any disclaimer, the term of this patent is extended or adjusted under 35 U.S.C. 154(b) by 0 days.

(21) Appl. No.: 13/985,034

(22) PCT Filed: Jun. 18, 2013

(86) PCT No.: PCT/KR2013/005441

§ 371 (c)(1),
(2), (4) Date: Aug. 12, 2013

(30) Foreign Application Priority Data

Nov. 16, 2012 (KR) ..... 10-2012-0130159

(51) Int. Cl.
*F21V 29/00* (2006.01)

(52) U.S. Cl.
CPC ..... *F21V 29/006* (2013.01); *F21V 29/2206* (2013.01); *Y10S 362/80* (2013.01)
USPC ..... 362/294; 362/249.02; 362/800

(58) Field of Classification Search
USPC ..... 362/249.02, 294, 311.02, 373, 800
See application file for complete search history.

(56) References Cited

FOREIGN PATENT DOCUMENTS

KR 20-0393425 8/2005
KR 10-2007-0116331 12/2007

(Continued)

OTHER PUBLICATIONS

KIPO Office Action, Notification of Provisional Rejection, Application No. 10-2012-0130159, Title of Invention: Heat cooling apparatus assembly of LED iluminating device having heat pipe and heat sink, Notice Date Mar. 6, 2013.

(Continued)

*Primary Examiner* — Jason Moon Han
(74) *Attorney, Agent, or Firm* — Margaret Polson; Oppedahl Patent Law Firm LLC

(57) ABSTRACT

The present invention provides the cooling apparatus assembly of the LED lighting device, consisting of a LED lighting apparatus mounting plate (300), heat pipes (400) that are secured at the opposite surface to the surface where the lighting apparatus is fixed, and heat radiation pins (500) that are mechanically pressed and fixed to the heat pipes. On the mounting plate (300) of said LED lighting apparatus, at least one fixing hole (320) is provided and the heat pipes (400) are fixed rearward by the binding bolt (310), perpendicular to the mounting plate. And the one end of the heat pipes (400) is comprised of a adherence pipe (441) and an inner pipe (442), where the adherence pipe(441), having circumferential uneven or rugged portion(451) at the outer surface, is positioned at the inner side of the heat pipes, and where the inner pipe (442), having a nut screw (410) to receive the binding bolt (310), is inserted into the adherence pipe (441) with pressing force. The other end of the heat pipes (400) are comprised of a adherence pipe (446) and an inner pipe (445), where the adherence pipe (445), having circumferential uneven or rugged portion (452) at the outer surface, is positioned at the inner side of the heat pipes, and where the inner pipe (445), having a nut screw (420) to receive and be fixed to the cap bolt (430), is inserted into the adherence pipe (446) with pressing force. The LED lighting device assembly further comprises a fore-front cap bolt (447) that is screwed into and fixed to the nut screw (420) of the inner pipe (445), in advance, in order for the cooling (working) fluid, filled in the interior space of the heat pipes not to flow out, a silicone material (440), having a high heat transfer efficiency, that is inserted between the fore-front cap bolt (447) and the cap bolt (430) before the cap bolt (430) is secured to block the air intrusion into the inside of the heat pipes, and the cap bolt (430) that is for the cooling (working) fluid not to flow out.

9 Claims, 5 Drawing Sheets

(56) References Cited

FOREIGN PATENT DOCUMENTS

| | | |
|---|---|---|
| KR | 10-2008-007812 | 8/2008 |
| KR | 10-2008-0071812 | 8/2008 |
| KR | 10-2010-0132213 | 12/2010 |
| KR | 10-1031650 | 4/2011 |
| KR | 10-2011-0072651 | 6/2011 |
| KR | 20-0460223 | 5/2012 |
| KR | 20-0460223 | 6/2012 |
| KR | 10-1272456 B1 | 6/2013 |

OTHER PUBLICATIONS

Written Opinion of the International Searching Authority—International application No. PCT/KR13/05441 (in Korean).
Written Opinion of the International Searching Authority—English translation. 5 pages.

HEAT COOLING APPARATUS ASSEMBLY OF LED ILLUMINATING DEVICE HAVING HEAT PIPE AND HEAT SINK

TECHNICAL FIELD OF THE INVENTION

The invention generally relates to a cooling apparatus of the LED lighting device using heat pipes, and more specifically, it relates to a cooling apparatus assembly of LED lighting device for effectively cooling the heat generated in the LED lighting device, using heat pipes.

BACKGROUND OF THE INVENTION

LED (Light Emitting Diode) is a kind of a semiconductor which uses the principle of emitting light by converting electric energy into light energy and emitting light when an electrical power is applied to the LED. The lighting apparatus, using this kind of LED, is advantageous in that it has a low electrical energy consumption, a high energy efficiency, a long life span and it can produce various colorful lights compared to the existing fluorescent or incandescent lamps. However, the LED lighting device that is currently used, has the problem of generating high heat when it is operated, which must be cooled off effectively.

In the following introduction, the cooling apparatus of the LED lighting devices of the prior art are disclosed, which features the cooling apparatus of the LED lighting device, combined with the mounting plate of the LED lighting device.

In the prior art KR10-1031650, one of the cooling apparatuses for the LED lighting device is disclosed as below.

The FIGS. 1 and 2 illustrate the status of the mounting plate (210) combined with the cooling apparatus (100) of the LED lighting device, according to the above prior art invention.

The cooling apparatus of the LED lighting device (100), in the illustrated prior art, comprises the heat pipe (110), the heat radiation pin (120) and the binding member (130). The heat pipe (110) is mechanically bound at its one end to the mounting plate (210), which is a part of the LED lighting device. The heat pipe is made pipe shaped and made of stainless steel. The heat pipe is usually made of metal with high heat conductivity like copper. However, there is a disadvantage in that the price of copper is expensive. Therefore it is usual practice that stainless steel is substituted for the copper.

In order to cope with the relatively lower heat transfer efficiency of the stainless steel, a different cooling fluid than the cooling fluid used for general heat pipe is used.

The heat radiation pin (120) is equipped at the other end of the heat pipe (110) and is preferable if it is made of material with high heat transfer coefficient like aluminum The heat pipe (110) and the heat radiation pin (120) are combined by way of extending the heat pipe (110) and pressing the radiation pin to tightly adhere to the extended heat pipe. By this way, there are advantages over the other, prior art that the heat transfer efficiency from the heat pipe (110) to the heat radiation pin (120) increases and the interior space of the heat pipe also increases.

However, the LED lighting device, as described above, has a problem in that the heat emitted from LED during the operation is not efficiently radiated, as the heat pipe is connected alongside to the mounting plate (210) and the heat emitted from LED is to be radiated only through the heat radiation pin (120) connected to the heat pipe at its one end. In addition, an additional constitution of the connecting member (130) is required to connect the heat pipe to the mounting plate, which results in its complicated constitution and additional expenses thereof.

Moreover, in one other Laid-open Publication KR10-2008-0071812 A for 'LED lighting Assembly Equipped with Cooling Apparatus Using Heat Pipe', is disclosed.

The FIGS. 3 and 4 illustrate the LED lighting assembly equipped with cooling apparatus using the heat pipe of the prior art. The LED lighting assembly (1) equipped with the cooling apparatus using heat pipe, comprises the heat pipe (10), LED combination (20), the radiating unit (30) and electrical connection (40).

The heat pipe (10) plays a role to rapidly transfer the heat generated by the LED (21) of the LED combination (20) to the radiating unit (30). The heat pipe (10), as shown in a cross sectional view in FIG. 4, has its interior space in vacuum condition. And the interior space is filled with a cooling (working) fluid. The heat pipe (10) is cylindrical shaped and has a heat absorption surface (12), a sealing surface (14) and sidewalls (16). The heat absorption surface (12) is the lower-part of the heat absorption cap. The sealing surface (14) refers to the upper side of the sealing cap. And a through-hole (11) is placed between the heat absorption surface (12) and the sealing surface (14). That is, there is a hole formed in the center area of the heat pipe (10) that is completely running through from the lower-part of the heat absorption cap to the upper side of the sealing cap.

The through-hole (11) is formed by the interior tubular member (18). With reference to the FIG. 9 of the laid-open prior art publication, there are sintered works (58, 60) provided respectively to the upper side of the heat absorption cap and to the inner side of the interior tubular member (18). In the meantime, the sintered work (62), sintered with metal powder, is also provided to the inner side (180) of the interior tubular member (18). Here, the inner side (180), of the interior tubular member (18), means the side toward the interior space (100) of the heat pipe between both sides of the interior tubular member (18).

In the conventional prior art, as introduced in the above, the heat pipe (10) is coupled to LED combination (20) by way of the solder. However, this type of cooling system is comparatively quite large and heavy in view of the usual size of the LED lighting device and therefore, is not suitable for the LED lighting device of high illumination.

SUMMARY OF INVENTION

Problem to be Solved

In the cooling apparatus of the LED lighting device of the prior art, KR10-103165 has problems in that an additional constitution of the connecting member is required to connect the heat pipe to the mounting plate, the cooling efficiency is lower as the heat pipe is adhered completely to the mounting plate and the heat radiation pin is connected to the heat pipe at its one end only. These problems are caused by the fact that the heat pipe is connected alongside to the mounting plate through the combining member and the heat radiation pin is connected to the heat pipe at its one end only.

Moreover, in KR10-2008-0071812 A, the heat pipe is coupled to LED combination by way of solder. However, this type of cooling system is comparatively large and heavy in view of the usual size of the LED lighting device and therefore, is not suitable for the relatively large LED lighting device of high illumination.

The objective of the present invention is to provide a LED lighting device, including the cooling apparatus assembly, using the heat pipes of a new structure so that it is possible to effectively cool off the heat generated by LED device.

Solution of the Problem

According to one feature of the subject invention, a cooling apparatus assembly of the LED lighting device, including heat pipes and radiation pins, consisting of a LED lighting device mounting plate, heat pipes that are secured at the opposite surface to the surface where the lighting apparatus is fixed and heat radiation pins that are mechanically pressed and fixed to the heat pipes is provided, characterizing in that on the mounting plate of said LED lighting apparatus, at least one fixing hole is provided and the heat pipes are fixed rearward by the binding bolt perpendicular to the mounting plate, and that heat radiation pins, having multiple radial fins, are mechanically pressed and fixed to the heat pipe so that the high level of heat generated at the LED lighting device is radiated from the heat pipes to the heat radiation pins, and to the outside.

According to one other feature of the subject invention, a cooling apparatus assembly of the LED lighting device is provided, characterizing in that one heat radiation pin is fixed to the heat pipe circumference surface, adjacent to the mounting plate, and the other heat radiation pin is fixed to the heat pipe at the other end of the heat pipe, distant from the mounting plate, and that the heat pipes are configured to be fixed to the mounting plate rearward by the binding bolt at its one end, so that the heat pipe may be strongly connected to the mounting plate, and the cap bolt is secured to the heat pipes at the other end so that the working fluid, filled in the heat pipes, do not flow out.

According to further one other feature of the subject invention, a cooling apparatus assembly of the LED lighting device, including heat pipes and radiation pins, consisting of a LED lighting device mounting plate, heat pipes that are secured at the opposite surface to the surface where the lighting apparatus is fixed, and heat radiation pins that are mechanically pressed and fixed to the heat pipes is provided, characterizing in that on the mounting plate of said LED lighting apparatus, at least one fixing hole is provided and the heat pipes are fixed rearward by the binding bolt perpendicular to the mounting plate, that one end of the heat pipe is comprised of a adherence pipe and an inner pipe, where the adherence pipe, having circumferential uneven or rugged portion at the outer surface, is arranged at the inner side of the heat pipe and where the inner pipe, having a nut screw to receive the binding bolt, is inserted into the adherence pipe with pressing force, that the other end of the heat pipe is comprised of a adherence pipe and an inner pipe, where the adherence pipe, having circumferential uneven or rugged portion at the outer surface, is arranged at the inner side of the heat pipe and where the inner pipe, having a nut screw to receive and be fixed with the cap bolt, is inserted into the adherence pipe with pressing force, and that the LED lighting device assembly further comprises a fore-front cap bolt that is screwed into and fixed to the nut screw of the inner pipe in advance, in order for the cooling (working) fluid, filled in the inner space of the heat pipe not to flow out, a silicone material having a high heat radiation efficiency that is inserted between the fore-front cap bolt and the cap bolt before the cap bolt is secured to block the air intrusion into the inside of the heat pipe, and the cap bolt that is for the cooling (working) fluid not to flow out.

Effects of the Invention

The subject cooling apparatus of the LED lighting device, as described above, is comprised of the heat pipes and the heat radiation pins that are arranged perpendicular to the LED lighting apparatus mounting plate in order to enhance the heat radiating efficiency. With this structure arrangement, the heat radiated by LED can be rapidly absorbed at the heat pipes and can be radiated therefrom to the air through the heat radiation pins, which are also arranged perpendicular to the mounting plate at its rear side. With the structure that the heat pipes are directly connected to the LED lighting apparatus mounting plate, the connecting structure can be simplified and the heat radiation efficiency may be maximized without the combining member (130) as disclosed in KR10-103165 A. With this new structure the cooling apparatus assembly may also be minimized in its weight as opposed to the disclosures in KR10-2008-0071812 A, so that the cooling apparatus may be made lighter with an appropriate size meeting the lighting apparatus use. The lifetime of the LED lighting device may also be drastically lengthened with this new configuration.

DETAILED DESCRIPTION OF THE INVENTION

Figure 6:
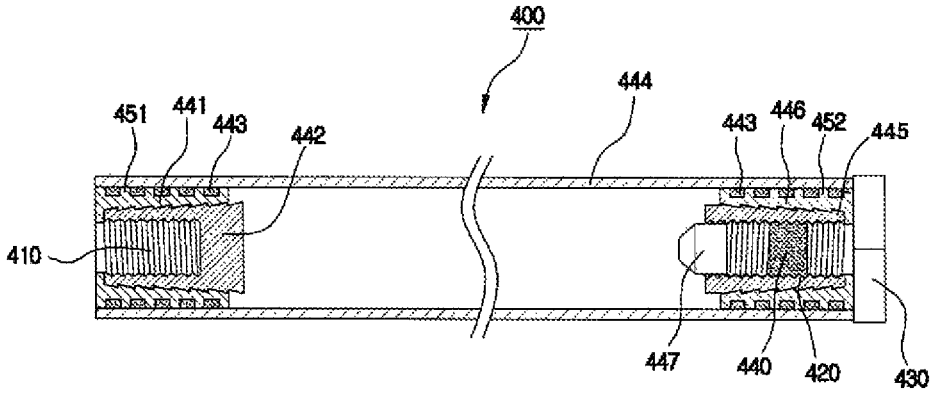
FIG. 6 is a view showing the detailed structure of a heat pipe.
Figure 7:
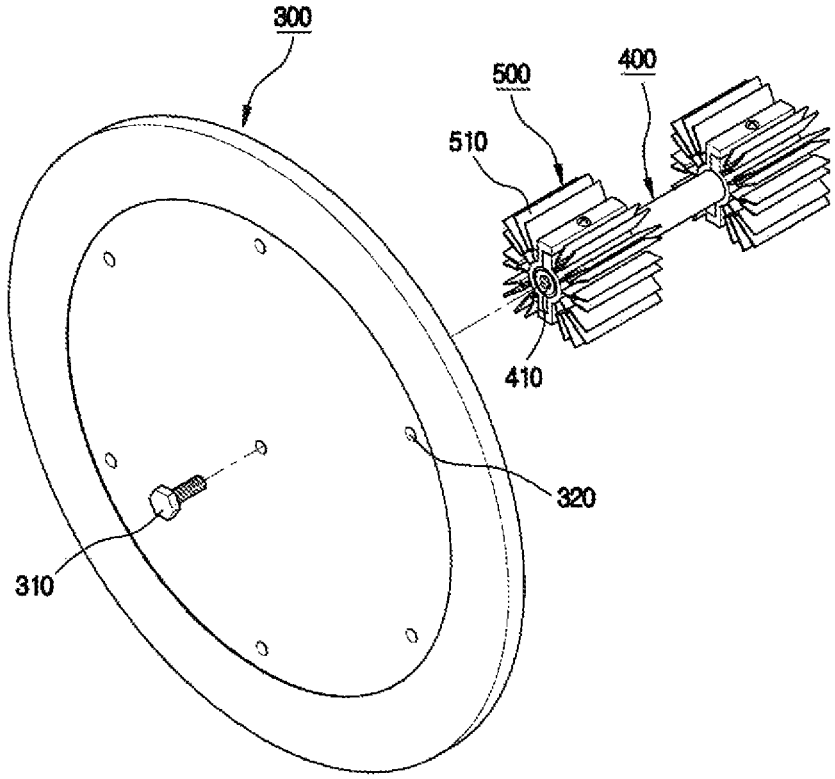
FIG. 7 is a view showing the assembly of FIG. 5 where the heat radiation pins are also shown to be secured to a heat pipe.
Figure 8:
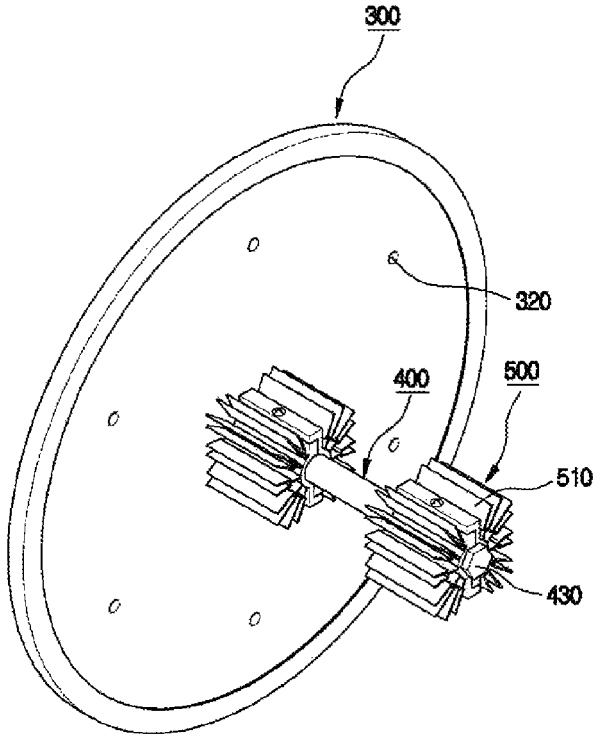
FIG. 8 is a view showing the state where a heat pipe and heat radiation pin assembly are attached to a mounting plate of the lighting apparatus.
Figure 9:
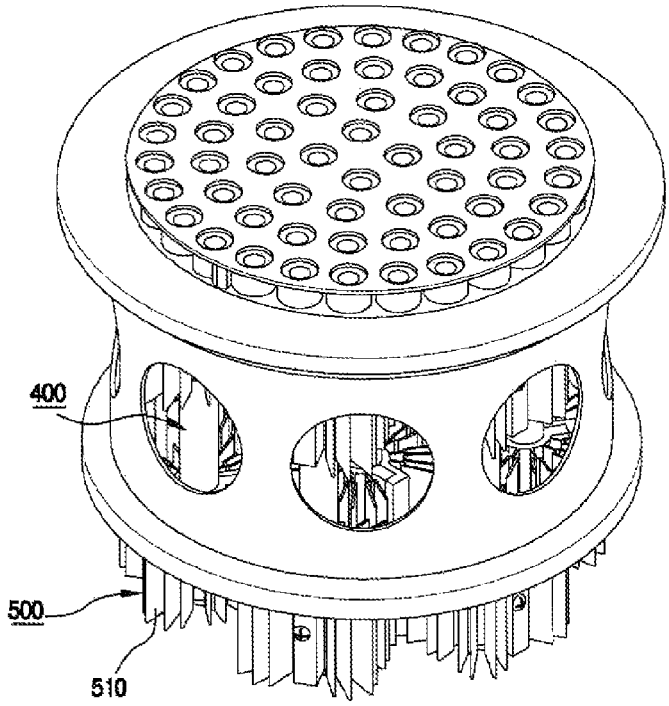
FIG. 9 is a view of the state where the cooling apparatus assembly for the LED lighting device is completed, according to the technology of the present invention.

The present invention is illustrated in particular with reference to the figures of the present invention. FIG. 6 is a view showing the detailed structure of a heat pipe of the present invention. FIGS. 7 and 8 are the views showing the assembly, according to the present invention where the heat pipe (400), of the cooling apparatus assembly of the LED lighting device, is secured to LED lighting device mounting plate (300) rearward and perpendicular thereto.

Figure 1:
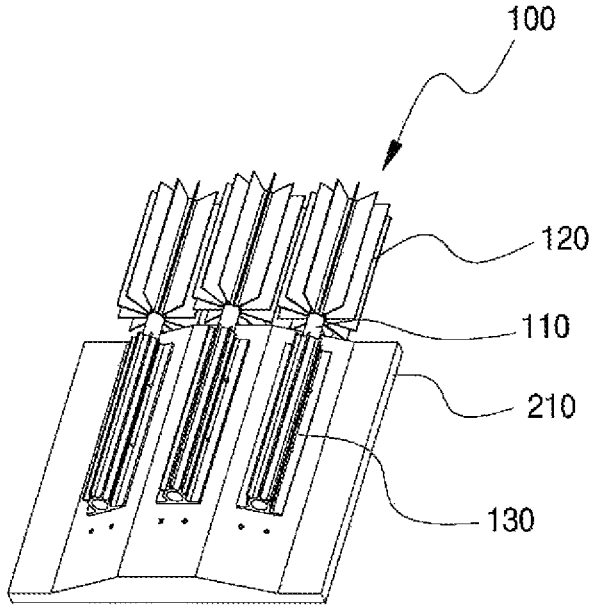
FIG. 1 is a view of a cooling apparatus for the LED lighting device according to the prior art where a heat pipe is attached to the mounting plate with a connecting member.
Figure 2:
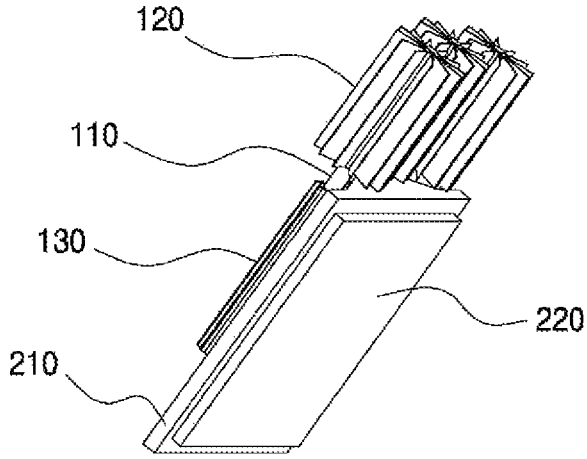
FIG. 2 is a side elevational view of FIG. 1.
Figure 3:
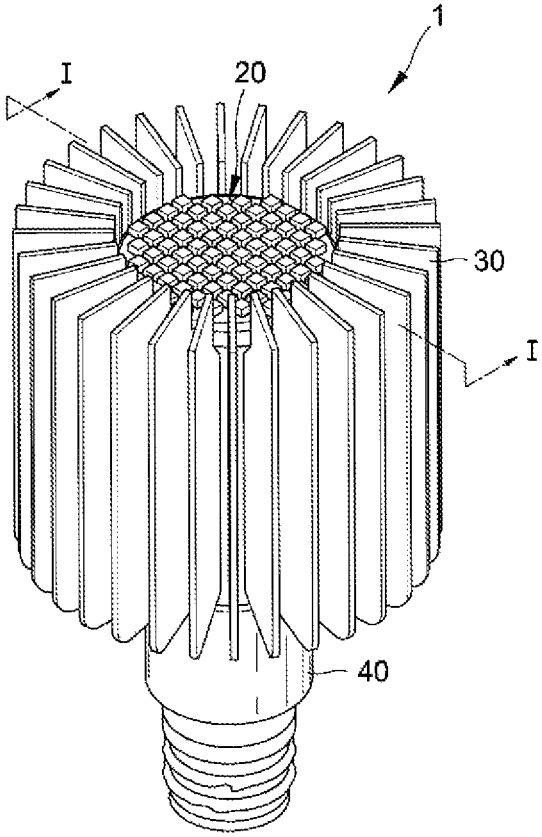
FIG. 3 is a perspective view of the LED lighting assembly, equipped with the cooling apparatus using a heat pipe, according to one other prior art.
Figure 4:
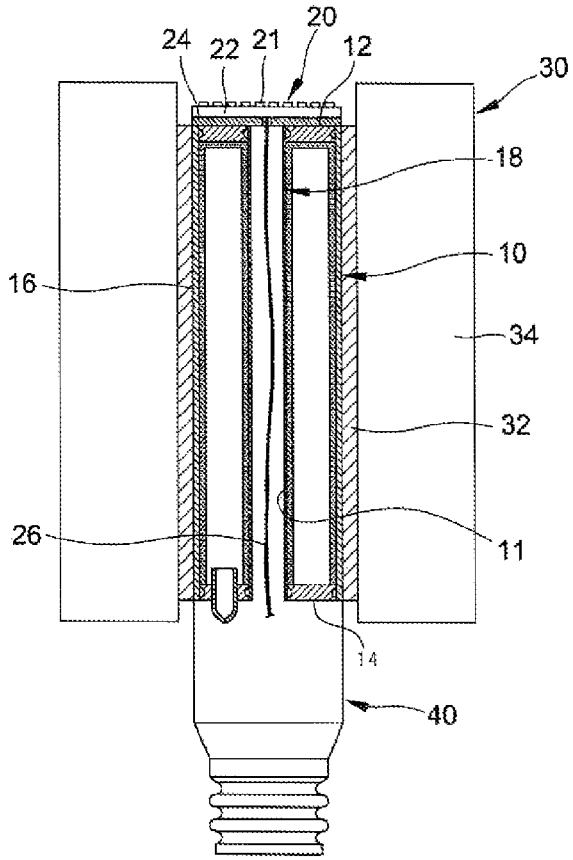
FIG. 4 is a schematic sectional view taken along II-II of FIG. 3.
Figure 5:
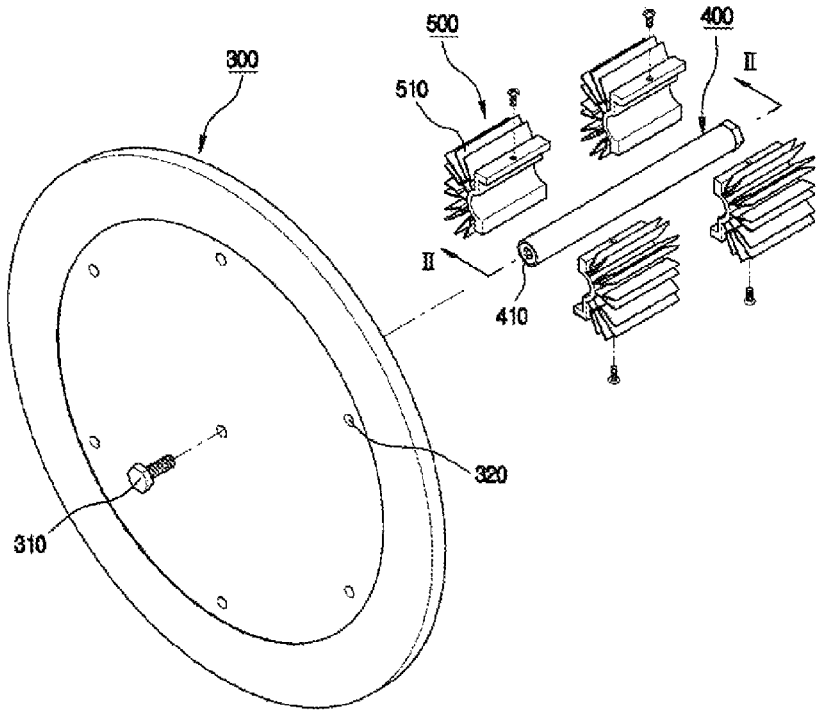
FIG. 5 is respective views for a mounting plate of the LED lighting device, a heat pipe and heat radiation pins, according to the present invention.

As shown in FIG. 5, the major configuration of the cooling apparatus of the LED lighting device, according to the present invention, is comprised of a LED lighting device mounting plate (300) of a disc shape, a heat pipe (400) that is secured at the opposite surface to the surface where the lighting apparatus is fixed, and heat radiation pins (500) that are mechanically fixed to the heat pipe with pressing force. (The number of heat pipes could be as many as required.)

On the disc shape mounting plate (300) of said LED lighting apparatus, at least one fixing hole (320) is provided, as shown in the FIG. 5, and the heat pipe (400) is fixed rearward, perpendicular to the mounting plate, by a binding bolt (310). As introduced later in a more detailed manner, the inner pipe (442), having a nut screw (410), is strongly fixed into the heat pipe so that the heat pipe is secured to the mounting plate by the binding bolt (310).

Moreover, the heat radiation pins (500), which have multiple fins (510) in the radial direction, is mechanically pressed and fixed to the heat pipe in order to effectively emit the heat of the high temperature generated in the lighting apparatus outside the heat pipe. The length of the heat radiation pins (500) is about ⅓ of the length of the heat pipe (400). And one heat radiation pin is fixed to the heat pipe circumference surface, adjacent to the mounting plate (300). The other heat radiation pin is fixed to the heat pipe at the other end of the heat pipe, remotely distanced from the mounting plate (300).

The lighting apparatus mounting plate (300) is made to be thick enough to sustain the plate where the LED lighting apparatus is adhered to at its one surface and one or more than one heat pipe is secured at the other surface of the plate. And it is desirable to manufacture the parts of the cooling apparatus of the LED lighting device with aluminum alloy, etc. of high thermal conductivity. In the meantime, the heat pipes (400), fixed to the lighting apparatus mounting plate (300), are configured to emit heat through this lighting apparatus mounting plate (300), to the outside, as is illustrated in detail in FIG. 6.

The heat pipes (400) of the present invention have a disc shape. The air outside is blocked from entering into the heat pipes and the internal space of the heat pipes is kept vacuum. The internal space of the heat pipes is filled with working fluid of high heat transfer rate so that the heat emitted from the LED lighting device mounting plate (300) could be rapidly radiated through the heat radiation pins (500). The heat pipe is configured to be fixed to the mounting plate (300) rearward by the binding bolt (310) at its one end, so that the heat pipes may be strongly connected to the mounting plate without the soldering. And a cap bolt (430) is secured to the heat pipe at the other end for the working fluid not to flow out after being filled in.

Looking back to the FIG. 6, the heat pipe body (444) is made to have a circular-shape cross-section, filled with the working fluid in its interior space, and is desirable to be made of magnesium alloy. In order to have the heat pipe (400) strongly secured to the mounting place (300) by way of fastening the binding bolt (310) into the fixing hole from the opposite side where the lighting device are attached to the plate, an adherence pipe (441) is prepared to have circumferential uneven or rugged portion (451), and an inner pipe (442) is prepared to have a nut screw (410) to receive the binding bolt (310). The inner pipe is inserted into the adherence pipe (441) with pressing force so that the inner pipe (442) is tightly secured to the adherence pipe (441). (The assembly process of the pipe bundles is provided in detailed manner in the below.)

The above inner pipe (442) is made of stainless steel of which is stronger than the strength of the adherence pipe (441) material, and the external diameter of the inner pipe at the leftmost end side is a bit larger than the internal diameter of the adherence pipe, and the external diameter of the inner pipe increases a bit gradually from the leftmost end side to the rightmost end side, according to the left side pipes of FIG. 6, so that the inner pipe may be tightly secured to the adherence pipe to make an unitary body once the inner pipe is forced into the adherence pipe in place with pressing force.

The adherence pipe (441) and the inner pipe (442), shown in the left hand side of FIG. 6, illustrate appropriately the size relationship between the interior diameter and the exterior diameter of the pipes. In order for the inner pipe (442) to be inserted into the adherence pipe (441), the inner pipe (442) of the relatively smaller diameter at its one end, compared to the other end, is inserted into the adherence pipe, and it is preferred that ⅓ of the inner pipe is inserted into the adherence pipe in advance. With the inner pipe being inserted into the adherence pipe, the adherence pipe, bundled and combined with the inner pipe, is forced into the heat pipe body (444) when the flow material (443) of silicon or Tefron are hardened after being coated at the interior surface of the heat pipe. After such insertion process, the inner pipe is further forced into the adherence pipe with some pressing force, according to commonly known methods, so that the inner pipe is completely fitted into the adherence pipe. During this assembling process, the diameter of the adherence pipe, the material of which has less strength than the one of the inner pipe, is a bit increased so that the adherence pipe is tightly secured to the heat pipe, along with the inner pipe (442), as clearly shown in the left hand side of FIG. 6.

In the meantime, a cap bolt (430) is screwed into the inner pipe (445) at the other end of the pipe body (444) so that the working fluid, filled in the heat pipe interior space, does not flow out from the heat pipe. The way that the inner pipe (445) and the adherence pipe (446) are related, for the cap bolt (430) to be tightly secured to the inner pipe (445), is the same as the way that the inner pipe (442) and the adherence pipe (441) are related.

That is, in order for the inner pipe (445) to be inserted into the adherence pipe (446), the inner pipe (445) of the relatively smaller diameter, at its one end compared to the other end, is inserted into the adherence pipe, and it is preferred that ⅓ of the inner pipe is inserted into the adherence pipe in advance. With the inner pipe being inserted into the adherence pipe, the adherence pipe, bundled and combined with the inner pipe, is forced into the heat pipe body (444) when the flow material (443) of silicon or Tefron are hardened after being coated at the interior surface of the heat pipe. After such insertion process, the inner pipe is further forced into the adherence pipe with some pressing force, according to commonly known methods, so that the inner pipe is completely fitted into the adherence pipe. During this assembling process, the diameter of the adherence pipe, the material of which has less strength than the one of the inner pipe, is a bit increased so that the adherence pipe is tightly secured to the heat pipe, along with the inner pipe (442), as clearly shown in the right hand side of FIG. 6.

Before the inner pipe (445) is tightly combined with the adherence pipe (446) within the heat pipe (400), as described in the above, a fore-front cap bolt (447) is screwed into and fixed to the nut screw (420) of the inner pipe (445), in advance, in order for the cooling (working) fluid, filled in the interior space of the heat pipe, not to flow out. And then, a silicone material (440), having a high heat transfer efficiency, is inserted between the fore-front cap bolt (447) and the cap bolt (430), before the cap bolt (430) is screwed and fixed to the nut screw (420) of the inner pipe (445), to block the air intrusion into the inside of the heat pipe. Thereafter, the cap bolt (430) is fastened to the nut screw (420) of the inner pipe (445) to complete the heat pipe assembling process.

The cap bolt (430), the fore-front cap bolt (447) and the adherence pipe (446) are all preferred to be made of the material of phosphor bronze, which is also used for the adherence pipe (441).

The heat radiation pins (500) are mechanically pressed and fixed to the surface of the heat pipes, at its left and right end, after the heat pipes (400) are prepared as in the above. The heat accumulated at the LED lighting device mounting plate (300) is transferred to the heat pipes and to the heat radiation pins (500) through the heat pipe. The heat radiation pins (500) consists of the heat discharge portions of the multiple fin shapes, as shown in FIG. 5 in order for the heat delivered to the pins through the heat pipe to radiate through the fins (510) of the heat radiation pins (500) to the outside.

The heat radiation pins (500), as shown in the figures, may be made symmetrically of one pair of the right and left sides and it can be fixed to a heat pipe (400) at the external surrounding surface of it. But the heat radiation pins (500) can also be fixed according to any other conventional known method to the skilled person in the art. There are two heat radiation pins (500) fixed to the heat pipe at the left and right end thereof in a feature of the present invention. However, there could be other ways of affixing the heat radiation pins (500) to the heat pipe, where a unitary structure or more than two pieces of the heat radiation pins is/are fixed to the heat pipe.

The working fluid, as used in the present invention for the cooling operation of the heat pipe, comprises a silicate mineral powder, jade powder, carbon powder, etc. Besides the materials mentioned, according to an experiment by the present inventor, the mixture of ethylene glycol: heterogeneity salts: tri-ethanolamine ethylene glycol can be used as the working fluid with a ratio of 1:1:1. And this mixture turns out to have an excellent heat radiation efficiency.

The efficiency for heat radiation, according to the present invention, can be achieved about 20~30% higher compared to the conventional national/international LED light devices. And especially, the cooling apparatus assembly of the present invention is suitable for the production of higher Watt of 100 W or above LED lighting apparatus. Moreover, the weight of the lighting apparatus of the present invention is 50~70% lighter than the products of any other companies for the same or similar lighting apparatus. Therefore the LED lighting apparatus, according to the present invention, is prominent and remarkable in its lighting efficiency, as well as the device weight over the prior art devices. And the lighting apparatus, according to the present invention, turns out to be particularly valuable over the ones of the prior art when the lighting apparatus is set up in higher ceiling.

The invention claimed is:

1. A cooling apparatus assembly of an LED lighting device comprising:

a mounting plate for an LED lighting device;

the cooling apparatus comprising heat pipes and heat radiation pins having multiple radial fins, said cooling apparatus secured at an opposite surface of the mounting plate from the lighting apparatus;

the radiation pins are mechanically pressed and fixed to the heat pipes;

the mounting plate having at least one fixing hole;

the heat pipes are fixed perpendicular to the mounting plate to the fixing hole by a binding bolt;

said binding bolt attaching directly to one end of the heat pipe; and wherein heat radiation pins are mechanically pressed and fixed to the heat pipe such that the high level of heat generated at the LED lighting device is radiated from the heat pipes to the heat radiation pins and to an outside.

2. The apparatus of claim 1, wherein one heat radiation pin is fixed to a heat pipe circumference surface adjacent to the mounting plate and another heat radiation pin is fixed to the heat pipe at an other end of the heat pipe, distant from the mounting plate.

3. The apparatus of claim 1, wherein the heat pipes are fixed to the mounting plate rearward by binding bolts at one end, so that the heat pipes may be strongly connected to the mounting plate, and cap bolts being secured to the heat pipes at the other end to retain a working fluid in the heat pipes.

4. A cooling apparatus assembly of an LED lighting device comprising:

a LED lighting device mounting plate;

heat pipes and heat radiation pins;

said heat pipes being secured at an opposite surface to an surface where an lighting apparatus can be fixed;

the mounting plate having at least one fixing hole;

the heat pipes are fixed to the fixing hole by a binding bolt perpendicular to the mounting plate;

the heat radiation pins having multiple radial fins mechanically pressed and fixed to the heat pipes so that the high level of heat generated at the LED lighting device are radiated from the heat pipe to the heat radiation pins, and to the outside;

one end of the heat pipe comprising an adherence pipe and an inner pipe;

the adherence pipe having circumferential uneven or rugged portion at the outer surface being arranged at the inner side of the heat pipe; and the inner pipe having a nut screw to receive the binding bolt is inserted into the adherence pipe with pressing force.

5. The apparatus of claim 4, wherein the other end of the heat pipe comprises a adherence pipe and an inner pipe, wherein the adherence pipe has a circumferential uneven or rugged portion at the outer surface, is arranged at an inner side of the heat pipe, and wherein the inner pipe has a nut screw to receive and be affixed with the cap bolt is inserted into the adherence pipe with pressing force.

6. The apparatus of claim 5 further comprising a fore-front cap bolt is screwed into and fixed to the nut screw of the inner pipe in advance to retain a working fluid filled in the inner space of the heat pipe and a silicone material having a heat radiation efficiency inserted between the fore-front cap bolt and the cap bolt before the cap bolt secured to block air intrusion into the inside of the heat pipe.

7. A cooling apparatus assembly of an LED lighting device comprising:

a mounting plate for an LED lighting device;

the cooling apparatus comprising heat pipes and heat radiation pins having multiple radial fins, said cooling apparatus secured at an opposite surface of the mounting plate from a lighting apparatus;

the radiation pins are mechanically pressed and fixed to the heat pipes;

the mounting plate having at least one fixing hole;

the heat pipes are fixed perpendicular to the mounting plate to the fixing hole by a binding bolt;

said binding bolt is accessible from the side of the mounting plate a lighting apparatus is mounted on;

and wherein heat radiation pins are mechanically pressed and fixed to the heat pipe such that the high level of heat generated at the LED lighting device is radiated from the heat pipes to the heat radiation pins and to an outside.

8. The apparatus of claim 7, wherein one heat radiation pin is fixed to a heat pipe circumference surface adjacent to the mounting plate and another heat radiation pin is fixed to the heat pipe at an other end of the heat pipe, distant from the mounting plate.

9. The apparatus of claim 8, wherein the heat pipes are fixed to the mounting plate rearward by binding bolts at one end, so that the heat pipes may be strongly connected to the mounting plate, and cap bolts being secured to the heat pipes at the other end to retain a working fluid in the heat pipes.

* * * * *